US007989760B2

(12) United States Patent
Schroeder

(10) Patent No.: US 7,989,760 B2
(45) Date of Patent: Aug. 2, 2011

(54) EXTRACTION DETECTION SYSTEM AND METHOD

(75) Inventor: Terrence K. Schroeder, Bernardsville, NJ (US)

(73) Assignee: SWCE Inc., Bernardsville, NJ (US)

( * ) Notice: Subject to any disclaimer, the term of this patent is extended or adjusted under 35 U.S.C. 154(b) by 1014 days.

(21) Appl. No.: 11/807,026

(22) Filed: May 24, 2007

(65) Prior Publication Data

US 2010/0006753 A1 Jan. 14, 2010

Related U.S. Application Data

(60) Provisional application No. 60/808,019, filed on May 24, 2006, provisional application No. 60/809,744, filed on May 31, 2006, provisional application No. 60/809,742, filed on May 31, 2006, provisional application No. 60/812,532, filed on Jun. 9, 2006, provisional application No. 60/920,938, filed on Mar. 30, 2007.

(51) Int. Cl.
*H01J 49/26* (2006.01)

(52) U.S. Cl. ..... 250/288; 250/281; 250/282

(58) Field of Classification Search ..... 250/281, 250/282, 288; 95/82, 83, 84, 87; 96/101, 96/104, 105

See application file for complete search history.

(56) References Cited

U.S. PATENT DOCUMENTS 4,615,258 A * 10/1986 Hirmann ..... 92/40
5,884,417 A * 3/1999 Pare ..... 34/263
5,958,361 A 9/1999 Laine et al.
6,184,131 B1 2/2001 Sugai
2004/0094715 A1* 5/2004 Lewis ..... 250/339.02
2004/0096986 A1* 5/2004 Klein et al. ..... 436/514
2004/0124376 A1 7/2004 Ershov et al.
2007/0248700 A1* 10/2007 Alberte et al. ..... 424/769
2008/0038363 A1* 2/2008 Zaffaroni et al. ..... 424/502
2008/0249715 A9* 10/2008 Maione ..... 702/19

* cited by examiner

*Primary Examiner* — Robert Kim
*Assistant Examiner* — Nicole Ippolito Rausch
(74) *Attorney, Agent, or Firm* — Porzio, Bromberg & Newman, PC

(57) ABSTRACT

An apparatus, system and method for the continuous flow extraction, collection and analysis of small amounts of energetic substance/s and their reacted/unreacted residue/s in real time are provided. The apparatus includes an agitator that generates a particulate material from a surface. A vacuum gathers particulate material which is provided to a mixing module. The mixing module creates a supercritical matrix containing the particulate matter. A separator separates and removes waste in the supercritical matrix from the supercritical matrix. Concentrated particulate material from the supercritical matrix is provided to a mass spectrometer for analysis and detection of a target material in proximate real-time. In one embodiment, the separator provides the supercritical matrix to a tube arm. The tube arm is heated to reduce solvent in the supercritical matrix. A collector in the tube arm concentrates particulate material, which is volatilized by a laser. Volatilized particulate material is provided to the mass spectrometer. In another embodiment, the separator provides the supercritical matrix to an electrospray or APCI module whose output is provided direct to the mass spectrometer.

16 Claims, 10 Drawing Sheets

EXTRACTION DETECTION SYSTEM AND METHOD

FIELD OF THE INVENTION

The present invention relates to material detection and more particularly to trace material extraction, analysis and detection.

BACKGROUND OF THE INVENTION

Increasing sophistication of explosive devices being used domestically and in the foreign arenas make detection of such explosive devices difficult using classical detection devices. Characteristics of the material in which an explosive device is hidden prior to detonation, or buried in the case of an improvised explosive device in a combat zone, can also act to defeat classical detection devices. For example, vapor typically given off by an explosive may adhere to the material or soil in which the explosive is hidden such that vapor pressure alone can not be relied on to provide a sample that can be tested for the presence of an explosive. In addition, non-nitrogen based explosives may even be undetectable using conventional detection devices. The importance of detecting an explosive prior to detonation can not be understated due to the resultant effects of detonation when the explosive is used as a weapon.

Further, determination after explosive detonation of the presence of an explosive and/or explosive residue suitable for testing is extremely difficult. Samples available for analysis after an explosion are minimal at best and contamination during extraction and testing of the samples is extremely critical as levels of sample mass and volume decrease. Direct identification and trace of the explosive utilized in the explosive device after the fact is thus still more difficult.

During extraction and detection, significant mechanisms of contamination (and depletion of sample mass) between a solid surface and a fluid/gas include adherence, as mentioned above, and absorption. A sample may be depleted when particles are retained by frictional phenomena such as adherence to surfaces/s from mechanical "roughness" of surface topology. A sample may also be depleted by adherence to surface/s resulting from "physical adsorption" forces, such as van der Waals forces, the same as those which produce liquefaction. Sample depletion may also occur due to adherence to surface/s resulting from chemisorption; the adsorbed molecules react chemically with the surface, not beyond formation of a monolayer on the surface. Absorption through surfaces from diffusion also depletes samples, wherein the adsorbed molecules are moved to below solid surfaces to some state of kinetic equilibrium. These and other mechanisms result in the ratio of mass of the target material in the sample that absorbed (within a surrounding environment or on collection/extraction equipment) to mass of the target material in the sample that is desorbed (i.e., available for analysis) not always being 1:1.

Mass spectrometry provides the ability to characterize a physical sample and determine its composition via a measurement of mass-to-charge ratio of ions. The most popular mass spectrometer is the transmission quadrupole mass spectrometer which consists of two sets of parallel surfaces arranged so that the cross section forms two hyperbolae orthogonal to each other. These four conducting surfaces are the poles and can be manufactured as rods with the hyperbolic surface, as round rods, or as a single-quartz mandrel having the orthogonally positioned two-hyperbolae cross section with conducting material vapor deposited on the appropriate surfaces.

Hyperbolic electrodes are typically made from quartz which is ground into the desired geometry. Quartz is utilized because it has one of the lowest thermal expansions, which is necessary to maintain the hyperbolic shape. The hyperbolic quartz electrode is covered with multiple layers of titanium composite and gold. Unfortunately, rods with hyperbolic profiles are difficult to produce and fragile. Round (cylindrical) rods can be machined and manufactured from more rugged materials but the calculations necessary to determine the trajectory of the ions requires enormous computing power (which may require considerable expense and/or time) or a significant trade off in accuracy and resolution.

These factors and others contribute to the difficulty in being able to rapidly, efficiently and effectively detect dangerous substance/s. Rapid detection of the presence of a dangerous substance, such as detection of an explosive prior to the devastating consequences of the substance becoming present (i.e., detonation of an explosive device), is critically important and necessary to provide the safety and security the public demands.

SUMMARY OF THE INVENTION

An apparatus, system and method for the continuous flow extraction, collection and analysis of small amounts of energetic substance/s and their reacted/unreacted residue/s in real time are provided. The apparatus includes an agitator that generates a particulate material from a surface. A vacuum gathers particulate material which is provided to a mixing module. The mixing module creates a supercritical matrix containing dissolved and undissolved particulate matter. A separator separates and removes undissolved particulate waste in the supercritical matrix. Extracted (after solvent removal) concentrated particulate material from the supercritical matrix is provided to a mass spectrometer for analysis and detection of a target material. The extraction, collection and analysis process can occur in a continuous fashion in real-time or proximate real-time. In this manner, substances of interest may be identified and the undesired effects of an identified substance reduced/avoided by appropriate countermeasures.

In one embodiment, the separator provides the supercritical matrix to a tube arm. The tube arm is heated and reduces solvent in the supercritical matrix. A collector in the tube arm condenses/concentrates particulate material, which is volatilized by a laser. Volatilized concentrated particulate material is provided to the mass spectrometer. In another embodiment, the separator provides the supercritical matrix to an electrospray or APCI (Atmospheric Pressure Chemical Ionization) module whose output is provided directly to the mass spectrometer. The mass spectrometer characterizes samples of the concentrated particulate material. The mass spectrometer may utilize a tensor approximation or tensor calculation to expeditiously characterize the sample. The characterization of the sample is compared to those of known, target substances, for example, via absolute pattern identification, to identify samples of interest.

Various surface/s throughout the system that particulate material may contact may be specifically surface-treated to minimize inadvertent adsorption/catalytic modification of particulate material under examination. In addition, the fluid utilized to form the supercritical matrix can be varied and/or a coeluent added to the supercritical matrix to modify the solvent composition capabilities of the supercritical matrix. With controlled variation in real time of parameters impacting the supercritical matrix such as solvent composition, acoustic energy, temperature, pressure, and time, the system of the invention can provide detection of a variety of substances of interest regardless of the environmental conditions the test material is subject to at the surface.

BRIEF DESCRIPTION OF THE DRAWINGS

A more complete understanding of the present invention may be obtained from consideration of the following description in conjunction with the drawings in which.

DESCRIPTION OF VARIOUS ILLUSTRATIVE EMBODIMENTS

Figure 1:
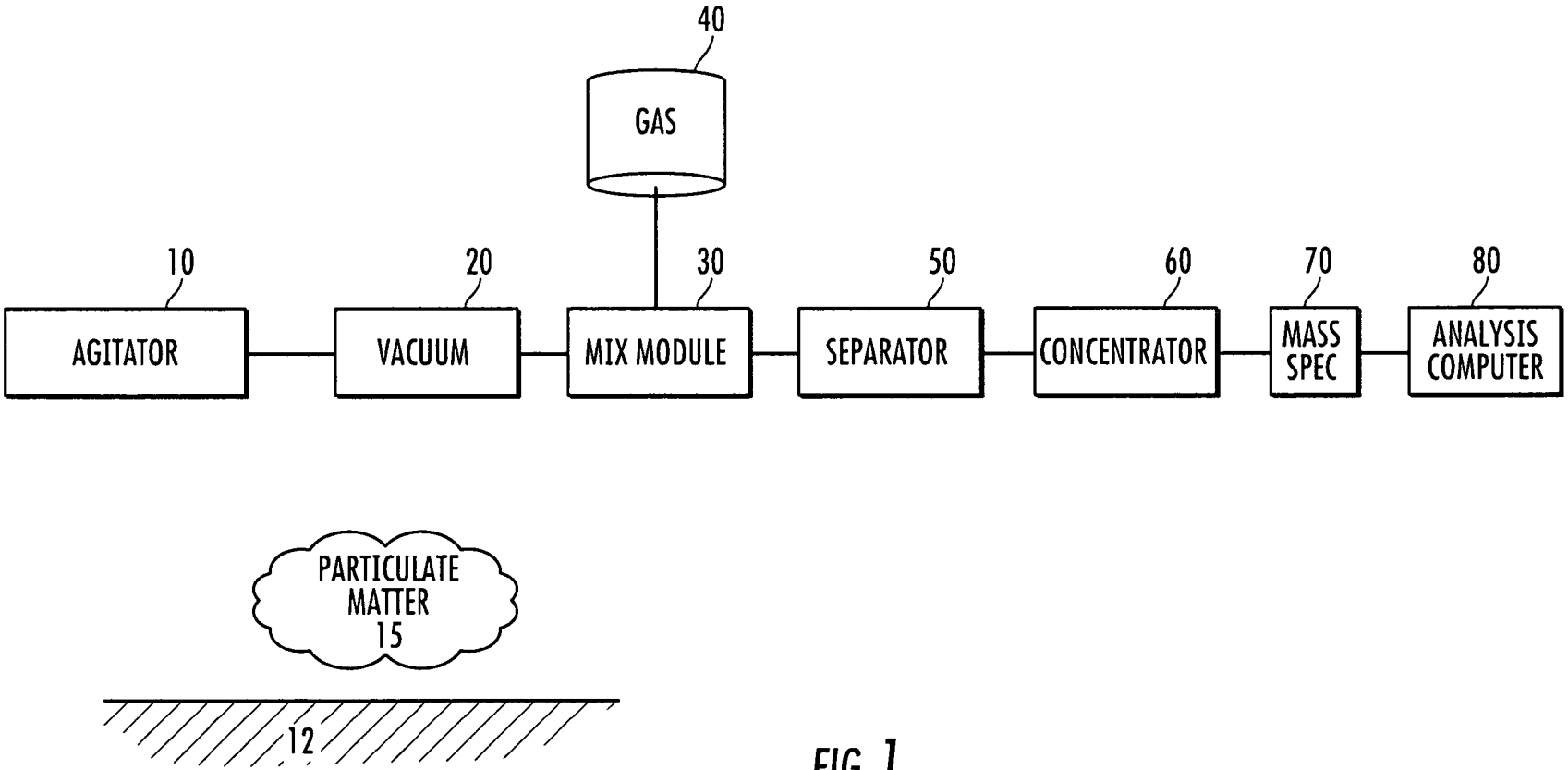
FIG. 1 is a functional block diagram of an embodiment of the extraction, collection and analysis system of the invention.

The present invention is an enhanced apparatus, system and method for the extraction, collection, concentration, analysis and detection of small amounts of substance/s. The system provides the ability to rapidly detect a substance such as an energetic substance/s and its reacted/unreacted residue/s. In particular, the system of the invention provides the ability to collect, extract and detect minute levels of substance/s such as explosives both prior to detonation and post detonation. With portions of the system in contact with the substance/s being tested specially surface treated, residual sample mass not desorbed (retained) of particulate material being tested is minimized and the residual sample mass desorbed is maximized. The system employs a rugged, easy to manufacture quadrupole mass spectrometer that employs a tensor approximation or tensor calculation to characterize the sample and thus does not require enormous computing power or a significant trade off in accuracy and resolution.

Reference will now be made in greater detail to embodiments of the invention, examples of which are illustrated in the accompanying drawings. Where possible throughout the course of this description, the same reference numerals will be used to identify the same or like elements.

FIG. 1 is a functional block diagram of an embodiment of the extraction, collection and analysis system. The system for the extraction, collection and analysis of small amounts of a substance, includes in the first instance an agitator 10. The agitator generates particulate matter 15 for testing. Particulate material for testing may be generated from a surface/s 12, such as the ground, a building, vessel and aircraft interiors/exteriors, forensic site locations, shipping containers (seaborne/airborne) and clothing/fabrics. The agitator may be a mechanical means such as a rake that traverses a surface such as soil to stir the surface and create a particulate material suspension in the air. In an alternate embodiment, the agitator may be a mechanism that creates a directed air or gas stream toward a surface. Any means or mechanism for disturbing a surface and causing particulate material in or on the surface to be propelled into the air may function as the agitator. Particulate material includes vapor in suspension above a surface. Particulate material to be tested includes energetic substance/s and their reacted/unreacted residue/s, toxins, chemical agents, explosives, etc. or any substance of interest.

A vacuum means 20 collects the particulate matter generated by the agitator. The vacuum means, which may be a vacuum or fan that creates a directed airflow, gathers the particulate material which is then provided to a mixing module 30. Alternatively, the system may dispense with an agitator and the vacuum merely collect particulate material disposed in air suspension without directly creating the particulate material. In the mixing module, a fluid 40 is combined with the particulate matter to form a supercritical matrix. The term supercritical is used in the context of exerting sufficient pressure at room temperature (70 degrees F.), or temperatures slightly elevated from room temp, to cause the coexistence of vapor and liquid states of a (normally at standard temp and pressure) gas or gaseous mixture. Ultra-pure high-pressure fluids (such as but not limited to carbon dioxide) can be used to pressurize and maintain the mixing module at the supercritical level/s desired.

This supercritical fluid acts as a solvent in the extraction of selected molecular species, collected by absorbance or adherence, from an inert substance under going testing (i.e., the particulate material). The solvating (i.e., extraction) properties of the supercritical fluid used in the extraction may be modified by fluid mixture composition, pressure profile and temperature profile. The solvating properties of the supercritical fluid may also be affected by the period of time solvent is applied to the particulate material undergoing testing and by the application of acoustic energy that serves to agitate the supercritical matrix and its particulate material.

The supercritical matrix is thereafter provided to a separator 50. The separator removes waste (undissolved/unextracted) particulate material from the supercritical matrix thereby leaving residual (dissolved/extracted) particulate matter in the supercritical matrix. The separator may utilize mechanical and/or ultrasonic agitation. When ultrasonic agitation is utilized in the extraction process, amplitude, frequency and pulse duration (time) may be varied.

Once extracted, the molecular species in the residual (dissolved/extracted) particulate material of the supercritical matrix may either be transported directly to a mass spectrometer for analysis 70 or concentrated 60 prior to analysis. Concentration can be accomplished by releasing pressure (and/or supplying heat, if required) from the supercritical solvent volume holding the residual (dissolved/extracted) particulate material and capturing the outflow in a cold trap. Another method for concentrating comprises heating the supercritical solvent volume holding the residual (dissolved/extracted) particulate matter and collecting a concentrate of the residual (dissolved/extracted) particulate matter on a cooled collector plate. The concentrate deposited on the collector plate can be volatilized and thereafter provided to the mass spectrometer for analysis. As a further alternative, the supercritical matrix containing the residual particulate matter can be nebulized and provided to the mass spectrometer.

Filters may be interposed in the system to screen particulate material at the vacuum means and/or to remove interferents from the volatilized concentrate prior to injection to the mass spectrometer 70. The mass spectrometer is used to develop a characterization of the concentrate. A computing device 80, such as an embedded processor, is programmed to develop and analyze the characterization of the concentrate and detect a presence of a substance of interest. A signal indicating detection of the presence of a substance of interest can be used to provide a warning and/or automatically cause an appropriate responsive action, such as stopping a moving vehicle carrying the system or a means conveying the test material past the vacuum of the system. The system operates in proximate real-time or in real-time in order that preventive/preventative action providing safety and security from the detected substance is enabled.

U.S. Provisional Patent Application No. 60/809,744, entitled Super Critical Fluid Extraction and Detection System, filed on May 31, 2006, and incorporated herein by reference, discloses a non-continuous flow, non-real time detection system, in which material such as a swab or fragments obtained via forensic procedures and potentially containing small amounts of substance(s) of interest are placed in a test chamber and the test chamber closed. A supercritical matrix is created in the test chamber and mechanical agitation applied by a heater/acoustic agitation assembly attached to the test chamber. Temperature, pressure and time parameters for the test chamber are individually and/or collectively controlled by a profile controller and after the extraction program profile has completed execution, a release valve is opened and supercritical fluid containing the extracted sample material is allowed to vaporize by passing through a metering valve 125. The extracted sample vapor may then be passed through a cold-trap for further concentration, or may be passed directly to the injection port of either the mass spectrometer for analysis or a gas chromatograph column for selective separation and then to the mass spectrometer for analysis.

Figures 2, 8:
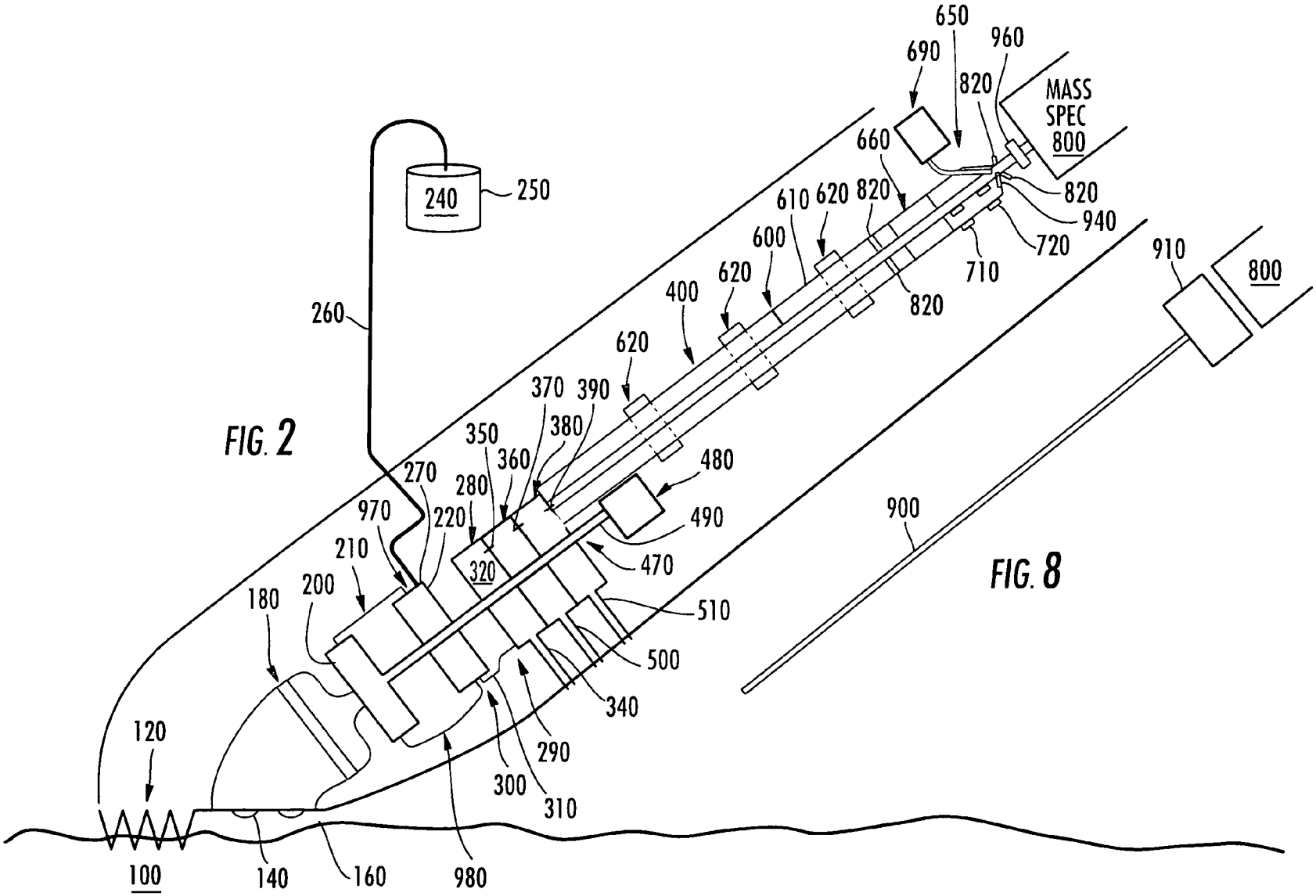
FIG. 2 is a detailed representation of a first embodiment of a system for the extraction, collection and analysis of small amounts of substance/s according to the invention.
FIG. 8 is a representation of a spray module for supplying samples to the mass spectrometer in a second embodiment of a system for the extraction, collection and analysis of small amounts of substance/s according to the invention.

FIG. 2 is a detailed representation of a first embodiment of a system for the extraction, collection and analysis of small amounts of substance/s according to the invention. The system illustrated by the embodiment of FIG. 2 is described in the context of a mobile configuration that may be fitted to a vehicle and finds a prime utility in a military/homeland defense scenario. Attached to a military vehicle, the system allows continuous testing for and detection of the presence of Improvised Explosive Devices (IEDs) in real-time and thus enables prevention of military injury, death and other losses. Other applications of the methods and systems described herein, such as use for airport and cargo screening, mine sweeping, pipeline leak screening and forensic crime scene investigation are contemplated. The system may be stationary or floor stand/cart mobile for transport in buildings and may be operated from a single phase power supply, either generator or utility provided. Vehicle mounted and vessel mounted system configurations may include a generator module.

An agitator 120, in this case a mechanical rake for disrupting a dirt surface, generates particulate matter (not shown) for testing. The rake traverses a surface 100 to stir the surface and cause the particulate material to be suspended in the air. Alternatively, the agitator may be a means for disturbing a surface and causing particulate material in, on or near the surface to be propelled into the air, such as fan/blower that creates a directed air or gas stream. The agitator is preferably arranged such that, while the surface is disturbed, the disruption of the surface is below the threshold necessary for detonation of pressure sensitive explosive devices. Particulate material such as soil, dirt, and surface debris including energetic material 100 is agitated/dislodged by the teeth of the mechanical rake 120. Particulate material includes vapor in suspension above the surface.

A vacuum device gathers the particulate material. In the illustrated embodiment, radial bladed blower 200 generates an airflow that sucks the air suspended particulate material through entry ports 140 in intake plate 160. The particulate material in air suspension may optionally be directed through protective screen 180 before reaching the radial bladed blower 200. The entry ports and protective screen act to filter particulate material greater than a predetermined size, preventing damage to the radial bladed blower and reducing the total amount of particulate material to be further processed. In an alternative embodiment, the agitator may be eliminated; such a system may use a vacuum to gather particulate material and/or rely solely on vapor pressure to gather particulate material for the mixing module.

While the discussed embodiment of the system is mobile and passes over the particulate materials for the extraction, collection and analysis of small amounts of substance/s, the system may be stationary and the surface to be tested can be passed before the entry ports to generate the necessary particulate material. For instance, in the case of an airport security device, luggage may travel on a conveyor, an air stream directed at the luggage and particulate material so generated accepted through the entry ports. Other applications of the system include testing of building surfaces, vessel and aircraft interiors/exteriors, forensic locations, shipping containers and clothing/fabrics. Substances to be tested include energetic substance/s and their reacted/unreacted residue/s, toxins, chemical agents, explosives, etc., or any substance of interest.

Particulate material and vapor in air suspension is provided to a mixing module for creation of a supercritical matrix. An exhaust port and transfer line 210 of the radial blower entrains and transports particulate material and vapor in air suspension to a six (6) port feed/mixing valve 220 via an inlet port 970. In the six (6) port feed/mixing valve, the particulate/vapor air suspension is mixed with supercritical fluid and a supercritical matrix formed. Fluid 240, for example liquid carbon dioxide ($CO_2$), from supply tank 250 is connected to a supercritical pump (not shown) and the output from the pump is connected to an inlet port 270 of the six (6) port feed/mixing valve 220 via coupling hose 260. The supercritical pump boosts the fluid pressure to a supercritical value prior to delivery to the mixing valve. Alternative gases such as but not limited to nitrogen, helium, neon, and xenon can also be provided to the chamber of the mixing module as desired. The fluid source/mixture is selected predicated on the specific sample requirements. To preclude sample contamination and potential reaction, the selected fluid source materials should be chemically inert with respect to the test material, free of oil mist or vapor and free of water vapor.

The system may have only a single fluid supplied from a single supply tank or multiple fluid and gas supply tanks can be provided for the delivery of a variety of fluids. As the chemical composition of the solvent in the supercritical matrix affects the solvating characteristic and different solvents are better able to extract different substances from particulate material, alternating delivery of a variety of fluids and/or gases allows for a wider ranging regimen of extraction and thereafter detection. In addition, changes in the environmental conditions of test material can impact the solvating capability of an individual solvent. For example, soil adhesion, adsorption and retention characteristics vary according to temperature, time of day, etc. Utilizing a variable composition supercritical fluid mixture, modes of operation for differing environmental conditions such as a daytime and night mode can be established. Further, a coeluent such as methanol or other known coeluents may also be added to the supercritical matrix at the mixing module to modify the solvating capabilities of the supercritical matrix. The coeluent would be supplied from a supply tank to a supercritical pump for pressure boosting and thereafter to another inlet port in the six (6) port feed/mixing valve 220 via another coupling hose. The coeluent is chosen to enhance the solvating capabilities of the supercritical matrix with respect to a chosen substance of interest that the system is directed to identify.

The matrix particulates and vapor in air suspension are fed from the radial blower into radial output/mix valve input port 970 and recycled through radial recycle port 980 of the mixing module. The mixing module produces a continuous output flow comprising an alternating output stream of slugs of the supercritical matrix including supercritical fluid and particulate material and vapor in air suspension. This output flow mix of supercritical matrix is fed via an output port 300 to a separator 280 for waste particulate (undissolved/unextracted) material removal.

Figure 3:
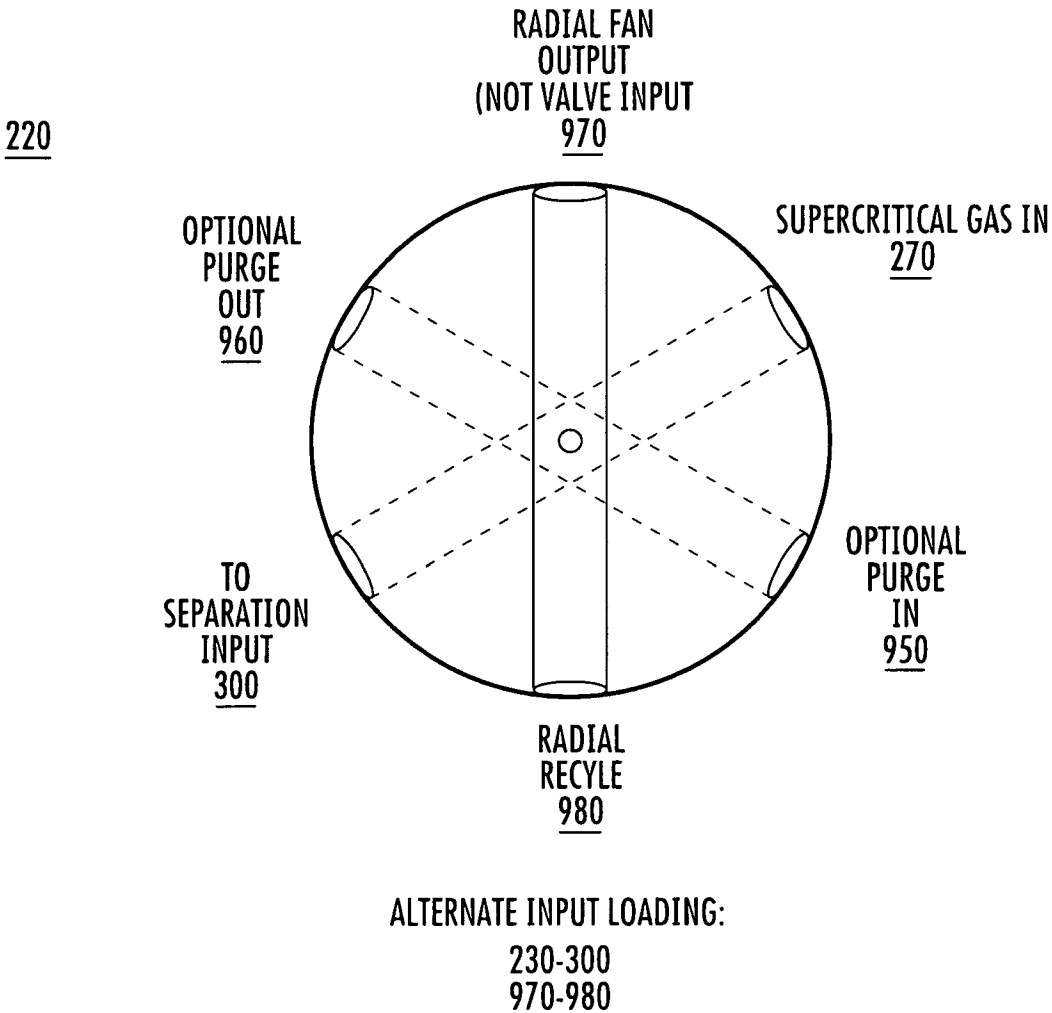
FIG. 3 is a detailed representation of input output loading of the mixing module of the exemplary system.

FIG. 3 is a detailed representation of input output loading of the six (6) port feed/mixing valve 220 of the mixing module of the exemplary system. The particulate material and vapor in air suspension are fed from the radial blower into radial output/mix valve input port 970. Radial recycle port 980 recycles supercritical matrix particulate material and vapor in air suspension from the chamber of the mixing valve. Recycled supercritical matrix can be redirected to the radial blower or elsewhere. Supercritical fluid is provided to the mixing valve via inlet port 270 and alternating slugs of the supercritical matrix including supercritical fluid and particulate material and vapor in air suspension provided via output port 300. From the output port, the slug or sample of supercritical matrix is thereafter fed to the separator. Optional purge in port 950 and purge out port 960 can be used for the addition of a coeluent to the supercritical matrix via the purge in port 950 and removal of a portion of the supercritical matrix via the purge out port 960. The purge in and purge out ports may alternatively be used for cleaning of the chamber of the mixing value. The mixing module may include additional input output port pairs.

Input loading pressures and volumes under program control, with optimally selected alternating volumes of particulate material/vapor in air suspension, supercritical fluid and a variable selection of coeluent or purge fluids, within the mixing module (230-300, 950-960, 970-980) produces and maintains a continuous output flow of supercritical matrix comprising dissolved and undissolved particulates in supercritical suspension. The valves in this configuration of the mixing module are solenoid controlled via an embedded real time processor system; other control methods may be utilized. Control of the mixing module may include real time management of parameters impacting the supercritical matrix such as solvent composition, acoustic energy, temperature, pressure and time. In this manner, external environmental conditions affecting the particulate material subject to testing can be addressed and detection of a variety of substances of interest is provided regardless of those environmental conditions. The supercritical matrix is provided from the mixing module to the three-stage separator 280 for waste removal after extraction from the particulate material by the solvent is complete.

Returning to FIG. 2, the supercritical matrix (particulate/vapor suspension in supercritical fluid) is metered into the three stage separator 280 inlet port valve 290 from the six (6) port feed/mixing valve 220 outlet port 300 via coupling 310. The separator removes waste particulate material from the supercritical matrix. Each stage of the separator includes a chamber with an input and an output port. The chamber has an eccentrically formed centrifugal particulate trap located on the outer exterior diameter of the chamber with a purge/exhaust valve located in the trap. Within the chamber, the supercritical matrix is agitated, waste particulate material separated into the trap and the waste exhausted. As a result of the waste removal, residual dissolved particulate matter remains in the supercritical matrix and that residual is output to the next stage of the separator or system.

The first stage separator chamber 280 has a hollow cylinder 330 with a supercritical matrix (fluid/particulate/vapor suspension) inlet port valve 290 located in the lower face (bottom) of the hollow cylinder. A supercritical matrix exhaust port valve 350 connects the first stage separator chamber 320 to the second stage separator chamber 360. Likewise, the second stage separator chamber 360 is connected to the third stage separator chamber 380 by supercritical matrix exhaust port valve 370. A supercritical matrix exhaust port valve 390 connects the third stage separator chamber 380 to a standoff concentric tube arm 400. The illustrated separator is a three stage separator however, the number of stages is not critical so long as a sufficient number of stages are provided to eliminate an acceptable/desired level of waste (undissolved) particulate material.

Figure 4:
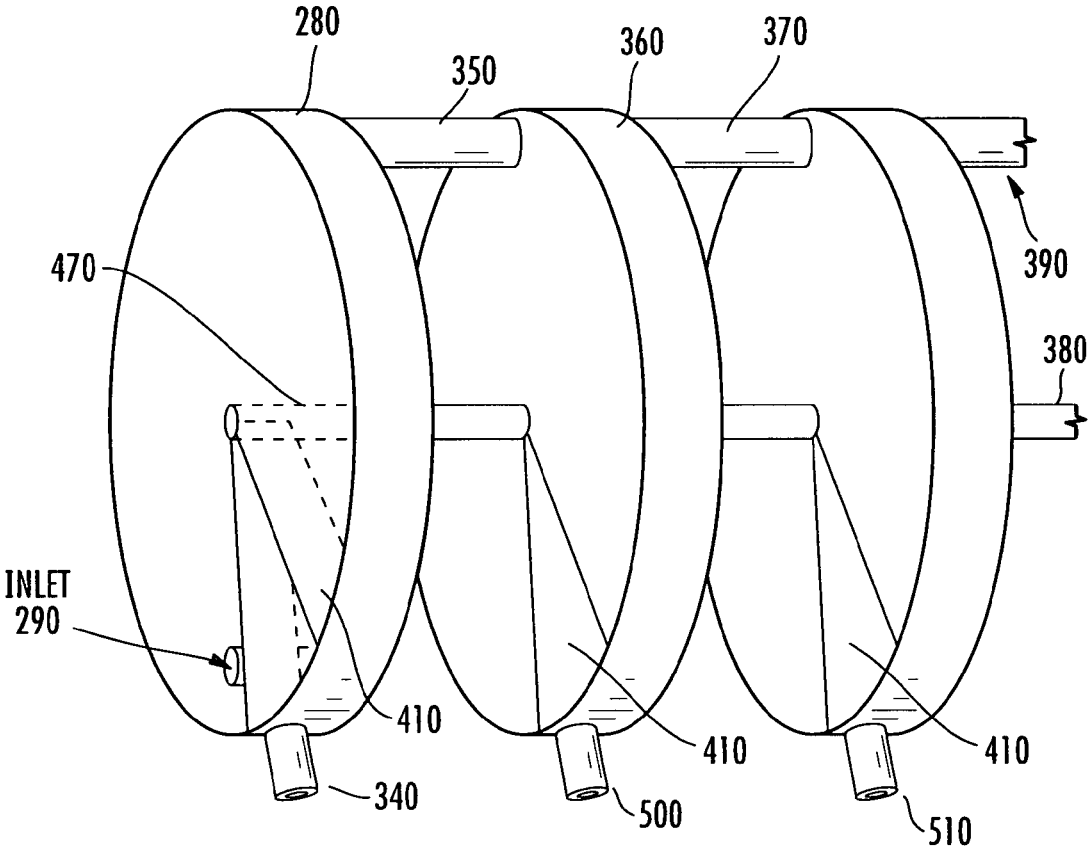
FIG. 4 is a detailed representation of the separator of the exemplary system.

FIG. 4 is a detailed representation of the three stage separator of the exemplary system. Each of the three separator chambers 280, 360, 380 of the separator 320 is fitted with a double wedge agitation device 410, which via rotary motion about a common coupling shaft 470 driven by motor (not shown), serves to stir the supercritical matrix 480. Inlet port valve 290 located in the lower face (bottom) of the first chamber initially receives the supercritical matrix from the mixing module. The output exhaust port valves 350, 370 and 390 connect the chambers of the stages of the separator and in the final instance connect to the next module of the system for transport of the supercritical matrix. The chambers have an eccentrically formed centrifugal particulate trap (not shown) located on the outer exterior diameter of the chamber with a purge/exhaust valve 340, 500, 510 located in the trap. When the agitation device 410 is rotated, the supercritical matrix is agitated and waste particulate material collected into the trap. The waste particulate material is occasionally purged from the chambers. Residual dissolved particulate matter remains in the supercritical matrix still within the separator. The supercritical matrix continues through the separator via the output exhaust ports 350, 370, 390. Coordination and control of the inlet port, agitation device, and purge/exhaust valves is accomplished via a system control program.

Figure 5:
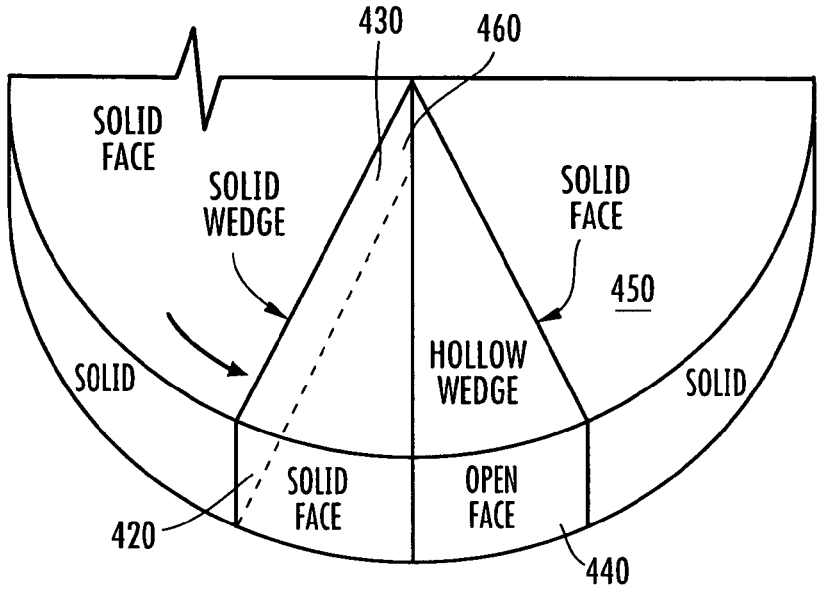
FIG. 5 is a detailed representation of agitation device of the separator in the exemplary system.
Figure 6:
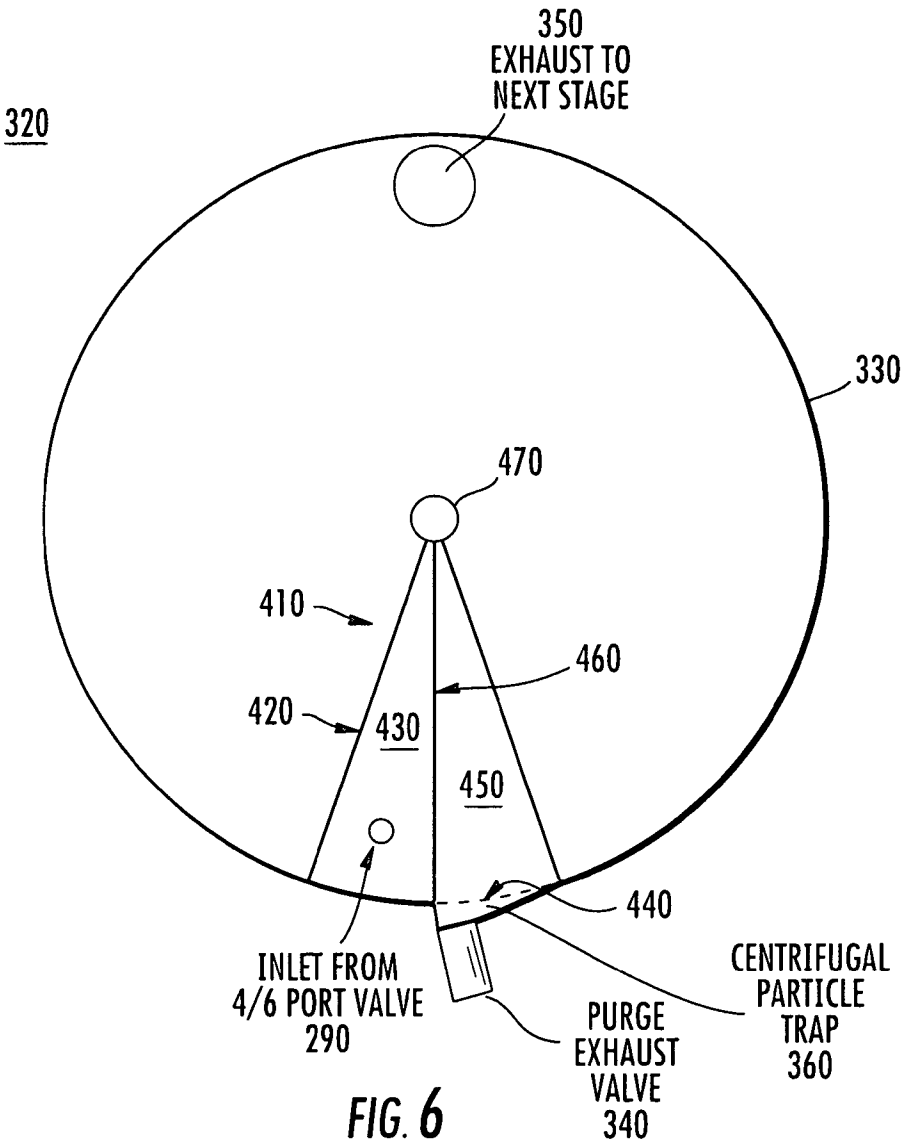
FIG. 6 is another representation of agitation device of the separator.

FIGS. 5 and 6 are detailed representations of an exemplary agitation device for the separator in the exemplary system. The illustrated agitation device 410 is a double wedged device. The first wedge of the agitation device has a solid outer/exterior face 420 with all remaining surfaces of the first wedge intact. The exterior face 440 of the second wedge 450 is open with all remaining surfaces of the second wedge intact; the interior of second wedge 450 is hollow. The first and second wedges 430, 450 share a common single wall 460.

The sharp edge of the wedge opposite the exterior face is rotationally driven by a coupling shaft 470.

During each cycle of revolution of the double wedge agitation device 410, centrifugal forces encountered by the particulate matter in the supercritical matrix (fluid/particulate/vapor suspension) cause a significant portion of the undissolved particulate matter to become deposited in the eccentrically formed centrifugal particulate trap 360. Under program control the purge/exhaust valves (340, 500, 510) of the separator may be opened for a program variable amount of time, a program variable number of agitator revolutions and/or a program variable lead/lag period of time in regard to any of the separator stages (280, 360, 380) in order to remove the post-extraction particulate matter waste in a continuous flow process. In this manner, at least a portion of the waste undissolved particulate matter in the supercritical matrix is removed thereby leaving residual dissolved particulate matter in the supercritical matrix.

The inlet and exhaust valves in a stage of the separator (for intake of the unextracted particulate/vapor suspension in supercritical fluid and for exhaust of the extracted product to the next stage or to the standoff concentric tube arm) also are operated under program control. The inlet and exhaust valves may be operated in synchronization with the particulate matter removal.

With respect to FIG. 2, after being metered into the first stage chamber 320 of the separator 280, the supercritical matrix is agitated by the double wedge agitation device via mechanical rotary motion from rotation of common coupling shaft 470 driven by motor 480. A reflective marker 490 on the coupling shaft 470 is used for valve timing and shaft rotation speed synchronization to supercritical fluid flow rates and forward transport speed in the system assembly. Additionally, the separator may utilize ultrasonic agitation with control of amplitude, frequency and pulse duration (time) to enhance the extraction process. Note that while individual motors can drive the radial blower and the separator, these motors can be combined/linked to reduce the possibility of extraneous electrical signals setting off any explosive in the vicinity of the system.

The supercritical matrix exhaust port valve 390 of the third stage separator chamber 380 connects to a standoff concentric tube arm 400. The standoff concentric tube arm 400 includes an inner tube 600 and an outer tube 610. The inner tube 600 is heated by radial, concentric set(s) of electrically powered heating coils (such as wrapped heat tape) 620 under program control. The heating serves to evaporate solvent in the supercritical matrix to form a concentrate of the dissolved residual particulate matter. The outer tube 610 serves as a protective jacket and thermal barrier. The length of the concentric tube assembly provides a "stand-off" distance that allows the operator and remaining portions of the system a level of physical isolation and safety from the source sampled.

The end of the concentric tube arm 400 opposite the separator connection contains a concentration module 650. Pressure and temperature gradient/s in the concentric tube assembly delivers dissolved residual particulate material from a receiving end of the tube arm at the separator connection to the concentrator at the opposite end. The tube arm volume holding the residual particulate matter is heated and a concentrate of the dissolved residual particulate matter collected on a cooled collector plate. An insulating barrier 660 thermally isolates the concentration module from the main body of the concentric tube arm. Concentrate deposited on collector plate is volatilized by a laser 690 and thereafter a sample of the concentrate is provided to the mass spectrometer 800 for analysis after optionally passing through separation membrane/filter assembly 960 to remove water vapor and/or other matrix interferent.

Figure 7:
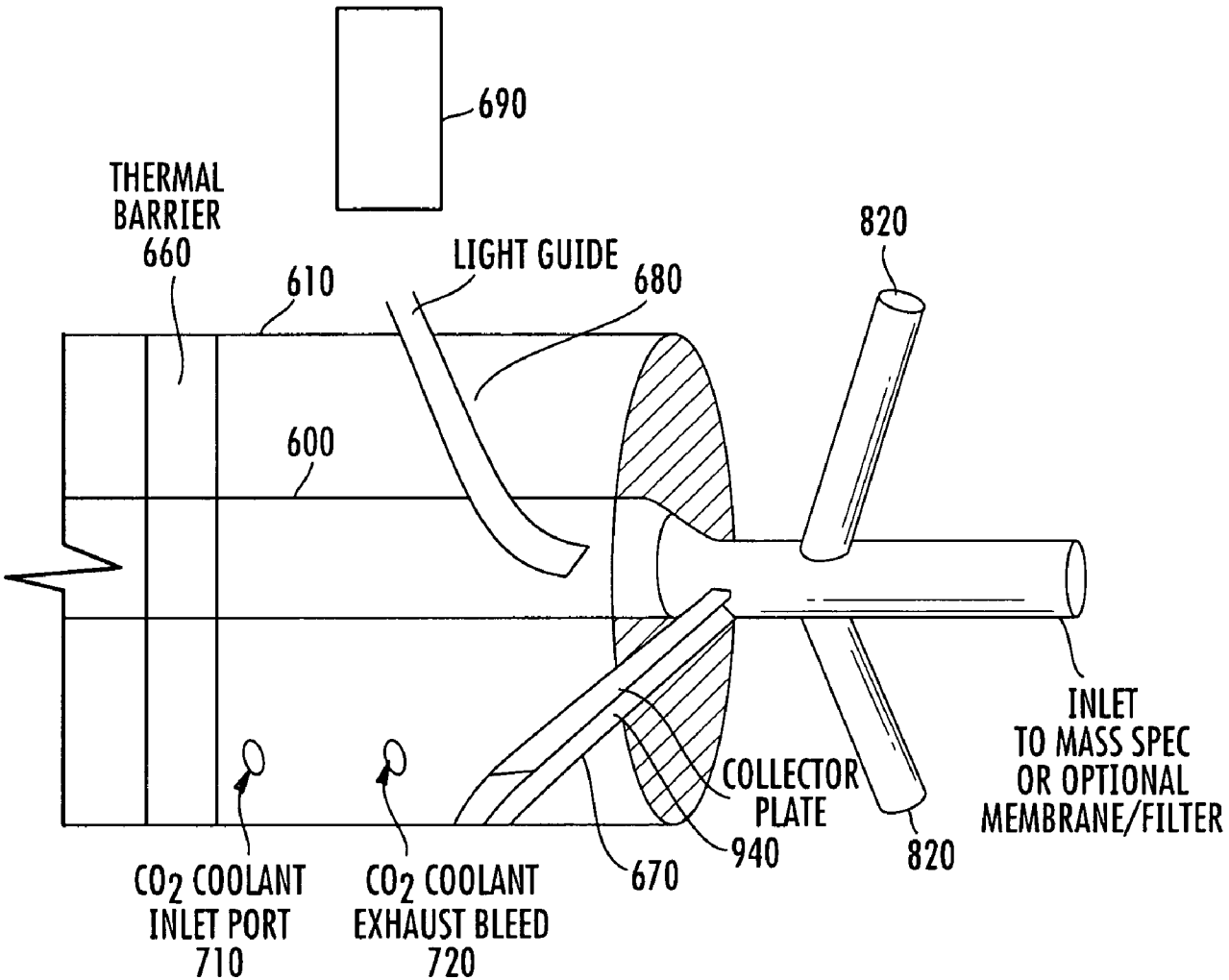
FIG. 7 is a detailed representation of tube arm used to supply samples to the mass spectrometer in a first embodiment of the system according to the invention.

FIG. 7 is a detailed representation of the concentration module used to supply samples to the mass spectrometer in a first embodiment of the system according to the invention. The concentration module is thermally isolated from the main body of the concentric tube arm by insulating barrier 660. The thermally isolated concentric tube arm portion includes a collector plate 670 mounted between the inner surface of the outer tube 610 and piercing through the outer surface of the inner tube 600 and extending within the inner tube. The collector plate functions to condense the extracted particulate material from the supercritical matrix but also can impede or disturb the flow of evaporated solvent if overly restrictive with regard to air flow. Therefore, the internal area of the inner tube occupied by the surface of the collector plate may vary with the range of pressures and flow rates specific to the selected (under program control) operating configuration. A mechanical means to move is collector plate is thus included. The surface for collector plate includes an opening with hyperbolic shaped side walls (e.g., a funnel or nozzle) on which the particulates may condense. This opening is centered over an inlet to the mass spectrometer and when the light energy from the laser warms the surface of the opening, a jet of condensed/concentrated particulate material is directed into the mass spectrometer for analysis. Note that the side wall of the opening may extend past the rear surface face of the collector plate.

The chamber formed by the junction/s of thermal barrier 660, the collector plate 670, the outer tube walls and the inner tube walls contains a liquid $CO_2$ inlet port 710 and a bleed/exhaust port 720. Other liquids may be used to cool the collector plate. A thermal barrier 940 further isolates the rear collector plate 670 wall surface from ambient temperatures.

The extracted supercritical matrix ($CO_2$/dissolved particulate material/vapor suspension) is allowed to expand inside the heated, under program control, inner tube where it becomes deposited on the cooled collector plate 670. The cooled collector plate 670 concentrates the extracted material once contained within the supercritical CO2. Excess CO2 is bled out of the inner tube through vent ports 820.

Light guide 680 focuses light energy from a laser 690 on the collector plate 670 surface. The light guide 680 is positioned, symmetrically opposite the collector plate, through the outer surface of the outer tube and the outer surface of the inner tube to enable focusing light energy from a laser 690 on the collector plate 670 surface. Laser energy under program control for pulse geometry and timing heats and volatilizes the concentrated material from the surface of the collector plate 670. The concentrated vapor is pulled into the mass spectrometer 800 for analysis. Optionally, water vapor or other matrix interferent may be removed from the concentrated vapor by separation membrane/filter assembly 960 prior to delivery to the mass spectrometer 800. Concentration/heating cycles under program control may be for periods of time as short a 0.001 sec up to several seconds of concentration and may be continuously varied.

The length of the concentric tube assembly provides a "stand-off" distance that allows the operator and remaining portions of the system a level of physical isolation and safety from the sampled source. For example, the "stand-off" distance serves to protect the mass spectrometer and operator from an explosive device when the system is mobile in a vehicle such as a military Humvee. In addition, the "stand-off" distance translates to a period of travel time that also permits a reaction time upon detection of an explosive.

FIG. 8 is a detailed representation of an alternative concentration module for supplying samples to the mass spectrometer in a second embodiment of a system for the extraction, collection and analysis of substance/s. In this alternative configuration, a single liquid tube 900 provides the "standoff" distance that allows the operator and system a level of physical isolation from the sampled source. The single liquid tube 900 is used to connect the supercritical CO2 particulate/vapor suspension exhaust port valve 390 of the third stage separator chamber 380 to the mass spectrometer 800.

The end of the single liquid tube 900 opposite the separator exhaust connection contains an electrospray or APCI (Atmospheric Pressure Chemical Ionization) module 910. The single liquid tube also provides the supercritical matrix to the electrospray or APCI (Atmospheric Pressure Chemical Ionization) module 910 which nebulizes the supercritical matrix. The electrospray or APCI module 910 is connected directly to the mass spectrometer input 800. In this operational configuration the extracted supercritical CO2/vapor suspension is not allowed to vaporize inside the standoff arm connection tube but is instead transported up the tube as a liquid suspension. The electrospray or APCI module 910 vaporizes and/or ionizes the supercritical matrix which is injected into the mass spectrometer 800 input port for analysis. Optionally the extracted supercritical matrix may be passed through a separation membrane/filter assembly 960 prior to mass spectrometer 800 entry to remove water vapor or other matrix interferent.

The ruggedized mass spectrometer is used to analyze the concentrate and develop a characterization of the concentrate. The characterization is further analyzed to detect a presence of a substance of interest, such as an energetic substance. The system preferably operates proximate real-time or in real-time in order that preventative action providing safety and security from the detected substance is enabled. Real time is short enough to take prospective action; in that case, the system of the invention may utilize a Real Time Operating System such as an embedded real time system that is not constrained by software.

The processor/s of the operating system is/are responsible for coordination of the overall operation of the mechanical aspects of the system, operation of the spectrometer including optimization of performance and data capture, and analysis/determination of the substance identified by the spectrometer.

In one embodiment of the control program for an embedded real time system for operation of the system according to the invention, four (4) core processors are utilized sharing a single memory address space, for example an eight-gigabyte (8 GB). A first core processor is dedicated to optimizing the quadrupole ion optic performance of the spectrometer. A second core processor is dedicated to data capture from the optimized quadrupole geometry and alignment/storage of the captured data in a designated section of the 8-gigabyte memory space. A third core processor is dedicated to pattern recognition algorithm execution on the aligned stored captured data so as to identify substances of interest. The fourth core processor is dedicated to coordinating the overall operation of the extraction/detection mechanics and alarms/threat management.

With respect to the operation of the first processor, U.S. Provisional Patent Application No. 60/808,019, entitled Non-Hyperbolic Quadrupole Mass Spectrometer, filed on Jun. 6, 2006, discloses a system and method for determining ion trajectory in a quadrupole mass spectrometer having non-hyperbolic ion optics and in particularly well suited for use with the present invention and is incorporated by reference as if set out in full. The system for determining ion trajectory in a quadrupole mass spectrometer having non-hyperbolic ion optics uses a tensor approximation or tensor calculation instead of using standard equations of motion. The tensor approximation is made by linearizing part of the matrix through point slope intercept logic. When dealing with the three dimensional space trajectory of the ions, the partial derivatives (coderivatives) of x, y and z are examined and focus given to whichever is the greatest. With application of point slope intercept to the tensors, a tensor approximation is determined rapidly relative to use of standard equations of motion which require significant matrix manipulation. The measurement and tensor approximation can be reiterated to improve accuracy.

With respect to the operation of the third core processor, a pattern recognition algorithm is executed on the aligned stored captured data. In order to provide rapid detection of substances, the analysis of the data developed by the mass spectrometer may be driven by absolute pattern identification. Absolute pattern identification means that simulants and surrogates will not be identified as substances of interest and false positives generated; it also means that they can not be used to test or calibrate the system. The processor/s may be programmed locally or remotely via a LAN or satellite, for specific substance profiles (toxic gases, energetic compounds, etc.).

The fourth core processor is dedicated to coordinating the overall operation of the extraction/detection mechanics and alarms/threat management. Extraction/detection mechanics include control of the various inlet ports, outlet ports, valves and motors found in the system. Mechanics controlled may also include management of parameters impacting the supercritical matrix such as solvent composition, acoustic energy, temperature, pressure and time. For example, the loading pressure or pressure differential across the various filter modules is monitored to track efficiency.

Alarm/threat management may include generation of a signal indicating detection of the presence of a substance of interest can be used to provide a warning or automatically causes an appropriate responsive action. For example, dependent upon the detection profile loaded (selected), when a detectable quantity of the selected substance is found present, a warning signal (e.g., flashing red light, enunciator—"IED, IED, IED" and/or siren/horn) may be provided to the operator. When the warning signal is issued, the operator is able to react accordingly and if necessary take the appropriate evasive or reactive action. Such a warning finds great utility in a military/homeland defense application of a mobile configuration fitted to vehicles, where the system may be used to detect IEDs in real-time mode.

The method for extraction of small amounts of energetic substance/s for sampling and detection comprises providing particulate matter including target material and waste material, creating a supercritical matrix including the particulate matter, removing at least a portion of the waste material in the particulate matter in the supercritical matrix thereby leaving residual particulate matter in the supercritical matrix; and providing concentration of the residual particulate matter in the supercritical matrix for analysis.

Providing particulate matter includes generating the particulate matter and transporting the particulate matter. Particulate matter is generated by agitating the particulate matter in or on a surface and is transported by the particulate matter.

A supercritical matrix is created by mixing the particulate matter with a supercritical fluid such as carbon dioxide. Removing a portion of the waste material in the particulate matter in the supercritical matrix includes the steps of separating the portion of the waste in the particulate matter in the supercritical matrix; and purging the portion of the waste from the supercritical matrix. Separating a portion of the waste may include agitating the supercritical matrix. Providing concentration of the residual particulate material comprises evaporating solvent in the supercritical matrix to form the concentration of the residual particulate matter and/or generating a sample from the concentration of the particulate matter may further include concentrating the concentration of the particulate matter. Alternatively, providing concentration of the residual particulate material may include volatilizing the concentration of the particulate matter and sampling a vapor of the volatilized concentration and further include filtering the vapor of the volatilized concentration.

The method for extraction of small amounts of energetic substance/s may further include analyzing the concentration to detect a presence of an energetic substance and/or characterizing the concentration using mass spectrometry and or comparing a characterization of the concentration to a characterization of at least one energetic substance and identifying matching characterizations. Providing concentration of the residual particulate matter in the supercritical matrix may include vaporizing/spraying/nebulizing the supercritical matrix. Interferents may also be filtering from the supercritical matrix. The method occurs in real-time or proximate real-time.

The method for extraction of a substance for sampling and detection according to the invention may be alternatively described as including the steps of generating particulate material including target particulate material, transporting the particulate material to a mixing stage, creating a supercritical matrix containing the particulate material at the mixing stage, separating waste particulate material from the supercritical matrix, removing the waste particulate material from the supercritical matrix; and extracting concentrate of the particulate material including target material from the supercritical matrix for analysis. The method can further include filtering the concentrate of the particulate material and/or generating a sample from the concentrate of the particulate material. The sample may also be analyzed to detect a target energetic substance. Analyzing the sample includes developing a characterization pattern for the concentrate of the particulate material using mass spectrometry, and comparing the characterization pattern for the concentrate of the particulate material to a characterization pattern for at least one energetic substance. The method may occurs in real-time or proximate real-time and can also include vaporizing/spraying/nebulizing the supercritical matrix prior to forming the concentrate of the particulate material. Extracting concentrate of the particulate material includes evaporating solvent in the supercritical matrix, collecting a deposit from the supercritical matrix, and vaporizing the deposit to form the concentrate of the particulate material.

Substance Characterization/Determining/Managing Ion Trajectory

The mass spectrometer is utilized to characterize a substance. In order to determine/manage ion trajectory in a rapid, efficient and effective manner, the system of the invention may utilize a unique method of determining/managing ion trajectory in a quadrupole mass spectrometer having non-hyperbolic ion optics. Although particularly well suited for use with round ion optics and so described, the method is equally well suited for use with other non-hyperbolic ion optic geometries, including ellipsoidal, near or approximation to hyperbolic shapes as well as other rounded geometries.

Typically, in a quadrupole mass spectrometer, two surfaces constituting one hyperbola are connected electrically with a positive DC voltage. The other two surfaces are connected with a negative DC voltage. An RF voltage at a fixed frequency and which has an amplitude that oscillates between positive and negative is also applied to all four surfaces. Ions of different m/z values are accelerated into this quadrupole field that separates ions as a function of a given DC and RF amplitude ratio. Ions are pushed and pulled as they transverse the field. Only ions of a single m/z value will be pushed and pulled to an extent that they can reach the other end of the field. Ions of all other m/z values will be 'filtered out' of the ion beam. Keeping the ratio of the RF and DC amplitude constant, the amplitude is increased to bring the next highest m/z value into focus for subsequent detection.

This stepwise incrementing of the amplitude of the RF and DC voltages while holding their ratio constant is how a mass spectrum is obtained. The limiting factor on the upper end of the m/z range is how high of an RF amplitude can be achieved without a disintegration of the wave. The size of the quadrupole filter is very small. When round rods are used in an instrument with an m/z range to 1,000, the rods can be the size of a ballpoint pen. Because the ions have to be pushed and pulled by the field, unlike the double-focusing mass spectrometer, low accelerating voltages are used to send the ions from the source to the m/z analyzer. The transmission quadrupole is typically limited in its ability to separate ions of different m/z values to a resolution of about 0.3. Most instruments are operated at unit resolution throughout the m/z scale, which means as ions have larger numbers of charges, the isotope peaks get closer together until they can no longer be distinguished from one another.

A quadrupole mass spectrometer is actually a mass filter rather than an analyzer because it transmits ions having only a small range of m/z values, and there is no mass dispersion or focusing as in magnetic analyzers. Thus, it is analogous to a narrow-band pass electrical filter that transmits signals within a finite frequency bandwidth, and a trade-off is made between transmission and resolution. The conventional quadrupole mass analyzer utilizes four parallel cylindrical or hyperbolically-shaped rods. The rods are long relative to the inner "kissing circle" diameter, to minimize fringing fields on the active length of the rods. A quadrupolar potential is established by applying a time-varying potential +PHI and −PHI on alternate rods (at the four locations ±x and ±y) for a dc component Uo, and an rf component Vo of frequency Omega. The ions are injected (in the z-direction) into the central "flip-flopping" saddle-potential region, and only those ions having the correct mass are transmitted to the exit aperture without sliding into one of the rods. The ion trajectories in the x- and y-directions are governed by the Mathieu equations.

A mass spectrum is obtained by sweeping Uo and Vo linearly (at a fixed Omega), and detecting the transmitted masses (one at a time) at the exit plane with a Faraday cup or particle multiplier. The resolution of the device depends on the rod geometry, frequency Omega, rod length, and axial and radial ion injection energies. In order to improve the sensitivity of a quadrupole mass spectrometer having non-hyperbolic ion optics, typically massive computing power is necessary perform the necessary calculation and the calculations must be fast enough to resolve the trajectory between individual ions.

The system of the invention may utilize a unique method of determining/managing ion trajectory in a quadrupole mass spectrometer having non-hyperbolic ion optics that uses a tensor approximation or tensor calculation and thus dispenses with use of standard equations of motion which require significant matrix manipulation, and thus calculation time. The tensor approximation is made by linearizing part of the matrix through point slope intercept logic. When dealing with the three dimensional space trajectory of the ions, the partial derivatives (coderivatives) of x, y and z are examined and the largest focused. By the application of point slope intercept to the tensors, a tensor approximation is rapidly determined. As this can be calculated rapidly relative to use of standard equations of motion which require significant matrix manipulation, the measurement can be repeated multiple times to improve accuracy.

The steps for optimizing determination of ion trajectory in a quadrupole mass spectrometer having non-hyperbolic ion optics comprises: constructing the field characteristics through which ions travel in a tensor format for the field space internal to the quadrupole; determining the partial derivatives (coderivatives) of x, y and z for three dimensional space trajectory of the ions; prioritizing partial derivative displacements by magnitude from greatest to least; applying point slope intercept to the selected derivatives to rapidly generate iterative tensor approximations; and, applying successive field modifications predicated on tensor approximations as ion mass is varied. Performing these steps permits rapid development of a characterization of a substance provided to a mass spectrometer so programmed. A control processor to the system of the invention may employ this method of optimizing the quadrupole ion optic performance of the spectrometer and thus enable rapid efficient characterization of the concentrate of a substance of interest. As a result, this optimizing process enables accuracy and resolution normally associated with hyperbolic geometries to be achieved via mathematical synthesis on non-hyperbolic ion optic geometries. The typically computing load associated with the processing of matrices associated with tensor evaluation is significantly reduced with the use of point intercept approximation logic. A target substance is a material which a system user wishes to detect such as a energetic substance like TNT, chemical agent like poison war gases, radiological materials, toxic waste residuals from manufacturing processes. Target substances often are encountered in a mixture with companion materials such as stablizers, plasticizers and binders. Once a target substance is detected, the system of the method preferably attempts to confirm the identity of the target substance by detecting the presence of companion substances.

A system for optimizing ion selection trajectories in a quadrupole mass spectrometer having non-hyperbolic ion optics comprises means for constructing field characteristics through which ions travel in a tensor format for the field space internal to the quadrupole; means for determining partial derivatives (coderivatives) of x, y and z for three dimensional space trajectory of the ions; means for prioritizing partial derivative displacements by magnitude from greatest to least; means for applying point slope intercept to the selected derivatives to rapidly generate iterative tensor approximations; and, means for applying successive field modifications predicated on tensor approximations as ion mass is varied.

The method for determining and managing ion trajectory in a quadrupole mass spectrometer can be described as including constructing field characteristics for the field space internal to the quadrupole through which ions of a target substance must travel in order to be detectable; applying the field characteristics to generate ion trajectories for ions within the field space; and detecting the ions of the target substance that have passed through the field space. The quadrapole may have non-hyperbolic ion optics or hyperbolic ion optics. Each of the steps of constructing, applying and detecting are iterative repeated for a plurality of target substances. Each of these steps may also be iterative repeated for companion substances, once ions a of target substance are detected in order to confirm the identity of a detected target substance and avoid false positive indications. That is, the method may further include constructing field characteristics for the field space internal to the quadrupole through which ions of a companion substance must travel in order to be detectable; applying the field characteristics for the companion substance to cause ion trajectories for ions of the companion substance within the field space; detecting the ions of the companion substance that have passed through the field space. Construction of field characteristics for the companion substance may occur either pre or post detection of the ions of a target substance. Constructing field characteristics comprises determining partial derivatives (coderivatives) of x, y and z for three dimensional space trajectory of ions, prioritizing partial derivative displacements by magnitude from greatest to least, and applying point slope intercept to the selected derivatives to generate iterative tensor approximations to a predetermined degree of precision.

Surface Treatments

In order to further enhance detection capabilities of the system, any and/or all surfaces that come into contact with particulate material and/or supercritical matrix may be surface treated to minimize inadvertent adsorption/catalytic modification or depletion processes. U.S. Provisional Patent Application No. 60/812,532, entitled Enhanced Detection System, filed on May 24, 2006, and herein incorporated by reference, discloses a surface treatment method comprising mechanically polishing 316L Stainless Steel with 400 Grit process abrasive; pressure spraying the 316L material with distilled water; pressure spraying the 316L material with a heated solution of potassium dichromate in sulfuric acid (chromic acid); pressure spraying the 316L material with heated deionized water; pressure spraying the 316L material with solution of ammonium bifluoride; immediately immersing the 316L material in a solution of ammonium bifluoride; pressure spraying the 316L material with heated deionized water; electropolishing the 316L material to approximately 4 Ra; pressure spraying the 316L material with deionized water; pressure spraying/immersing the 316L material with 50% solution of Nitric Acid in water; spraying the 316L material with heated deionized water; and, selectively coating the processed surface with selected agent processes such as siloxane/silylization. For example, interior surfaces of the mixing module, separator and the tube could be treated in the described fashion to minimize inadvertent adsorption/catalytic modification of material under examination.

316L Stainless Steel has an approximate composition as follows: 0.019 C; 1.312 Mn; 0.030 P; 0.014 S; 0.346 Si; 10.188 Ni; 16.721 Cr; 2.188 Mo; 0.059 N; 0.374 Cu; 0.160 Co. Structural elements of the system which contact particulate material and/or supercritical matrix may be formed from 316L Stainless Steel ("316L material") treated in the manner described.

The specific surface treatment may be applied to any and/or all surface/s that come into contact with fluid flow throughout the system to minimize inadvertent adsorption/catalytic modification of material under examination in contact with device surfaces, during both extraction and transfer. This surface treatment in turn enables minimal loss of sample input to levels compatible with the supercritical fluid extraction and detection device and the non-hyperbolic quadrupole mass spectrometer detector.

Each rinse involving distilled water entails measurement of the rinse water discharge for electric resistivity to a predetermined level, preferably 18.2 MegOhm-Cm. When electropolished to approximately 4 Ra, the 316L material being treated is placed in an electropolishing solution consisting of approximately >40% phosphoric acid and <50% sulphuric acid (at approximately 120 degrees F.) and fixtured as required. During the actual electropolishing phase, copper bus bars are utilized and fixtured to enable equipotential distribution and ensure consistent metal removal for the geometry of the component being electropolished. Agitation via stirring, in a closed vessel with the stirring flow supplied under pressure, is utilized to further this distribution. This agitation/stirring process is used to "normalize" the electrical potential within the solution as a function of distance from the solid surface which is due to the "double layer" phenomena created when two phases of different chemical composition come into contact with one another. The separation of charge is accompanied by an electrical potential difference, one side of the interface being positively charged, the other negatively charged. This fixed double layer is called the Helmholtz double layer.

There are multiple combinations of layer geometries/compositions—a diffuse component of the double layer is called the Gouy layer—combinations of the Gouy layer within the Helmholtz double layer geometry are called the Stern Double Layer.

The intended focus of the process is to utilize the double layer parameters to most closely obtain the set/s of conditions for optimum distribution of metal removal during the electropolishing process thereby increasing the "smoothness" of prepared surface. Any and/or all surface that comes into contact with particulate material and/or supercritical matrix may be surface treated in the described manner to enhance detection capabilities of the system.

This system of the invention is suited for use in the detection and identification of energetic substances associated with IED's since using it in the presence of sand, dust or other contaminants/obscurants, airborne or otherwise, does not preclude analysis. Although the enhanced extraction and detection system is particularly well suited for the detection of small amounts of energetic substance(s) and is so described herein, it is equally well suited for the detection of other low level concentrations of materials including but not limited to toxic agents (war gas) residue, trace herbicide concentrations, food contaminations, accelerants related to arson and radioactive contaminants from nuclear power plants/processing facilities.

Figure 9:
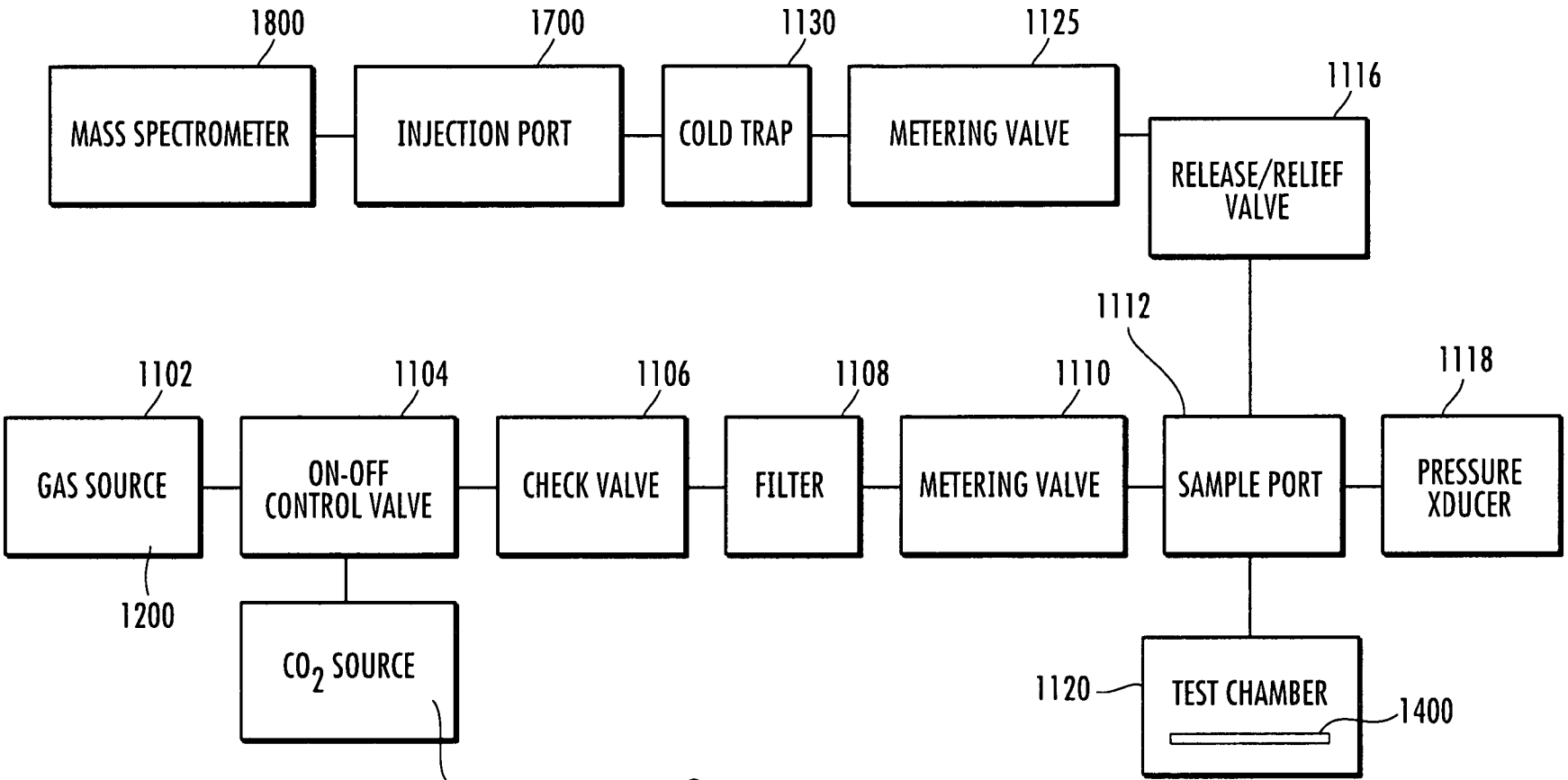
FIG. 9 is a functional block diagram of a super-critical fluid extraction and detection system.
Figure 10:
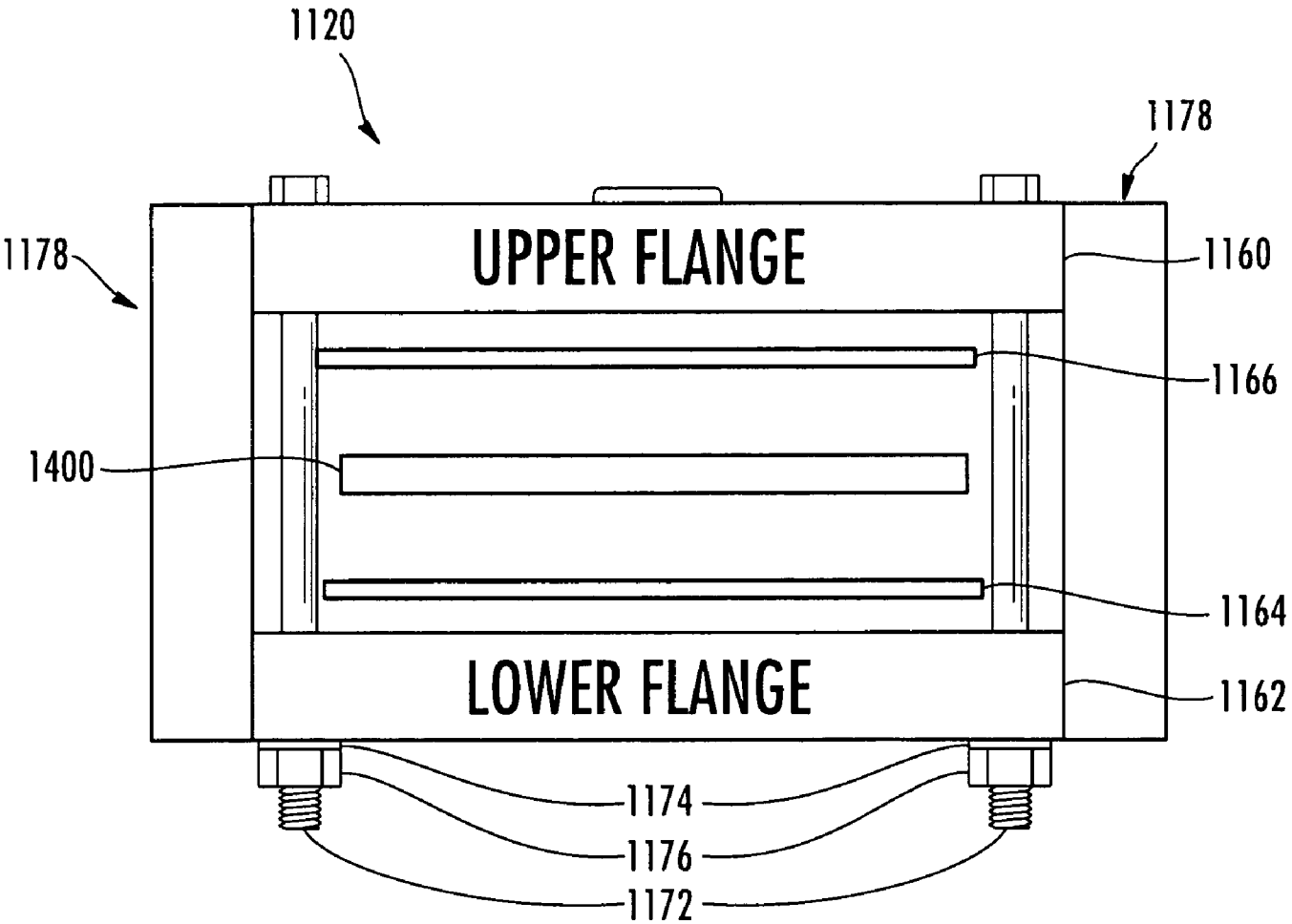
FIG. 10 is a more detailed representation of the test chamber in one embodiment of a super-critical fluid extraction and detection system.

In alternative embodiments, the material containing the small amounts of the energetic substance/s may be manually placed in a test chamber or mixing module having specially prepared surfaces wherein a super-critical solution then covers the material. Referring to FIG. 9, there is shown a representation of the test chamber of the present invention supercritical fluid extraction and detection system. The system is operated in forensic mode by loading a sample 1400 such as a missile fragment, swab or other contaminated piece of material in the sample chamber 1120. Flange gaskets (hollow ring configuration) 1164 and 1166 are used to surround the sample and form a gas tight connection. The upper flange 1160 and the lower flange 1162 are then brought into compressive contact by tightening the flange bolts 1172; lock washers 1174 and nuts 1176.

A pressurizer is then used to create and maintain a supercritical environment in the sample chamber. For example, the sample chamber may ben charged with liquid carbon dioxide by 1600 by opening control valve 1104 and allowing the liquid to pass thorough check valve 1106, filter 1108 and metering valve 1110. In this configuration, pressure accumulator 1114 is removed from the sample port and release/relief valve 1116 and pressure transducer 1118 are used to determine completion of test chamber fill.

Ultra-pure high-pressure gas (such as but not limited to nitrogen, helium, neon, xenon) 1200 is then used to pressurize the test chamber to the supercritical level/s desired. This is done by the conventional procedure for use of the MP-PITS device, using the same sequence as the liquid carbon dioxide 1600 loading.

Mechanical agitation, via ultrasonic (acoustic) energy may be applied to the extraction process by attaching the combination heater/acoustic agitation assembly 1178 which incorporates heating coils and piezoelectric transducers for agitating. Temperature, pressure and time may be individually or in any combination controlled by the same profile controller used in the standard MP-PITS configuration. The combination heater/acoustic agitation assembly 1178 surrounds (encircles) the chamber.

Referring to FIG. 9 there is shown a functional block diagram of the super-critical fluid extraction and detection system. When the extraction program profile has completed execution the release valve 1116 is opened and the supercritical fluid containing the extracted sample material is allowed to vaporize by passing through metering valve 1125. The extracted sample vapor may then be passed through cold-trap 1130 for further concentration, or may be passed directly to the injection port 1700 of either the gas chromatograph column 1720 for selective separation and then to the mass spectrometer 1800 for analysis. Optionally, the sample vapor either concentrated or as extracted, may be fed directly to the mass spectrometer 1800.

The gas source is selected predicated on the specific sample requirements. To preclude sample contamination and potential reaction, the selected gas should be chemically inert with respect to the test material, free of oil mist or vapor and free of water vapor.

Figure 11:
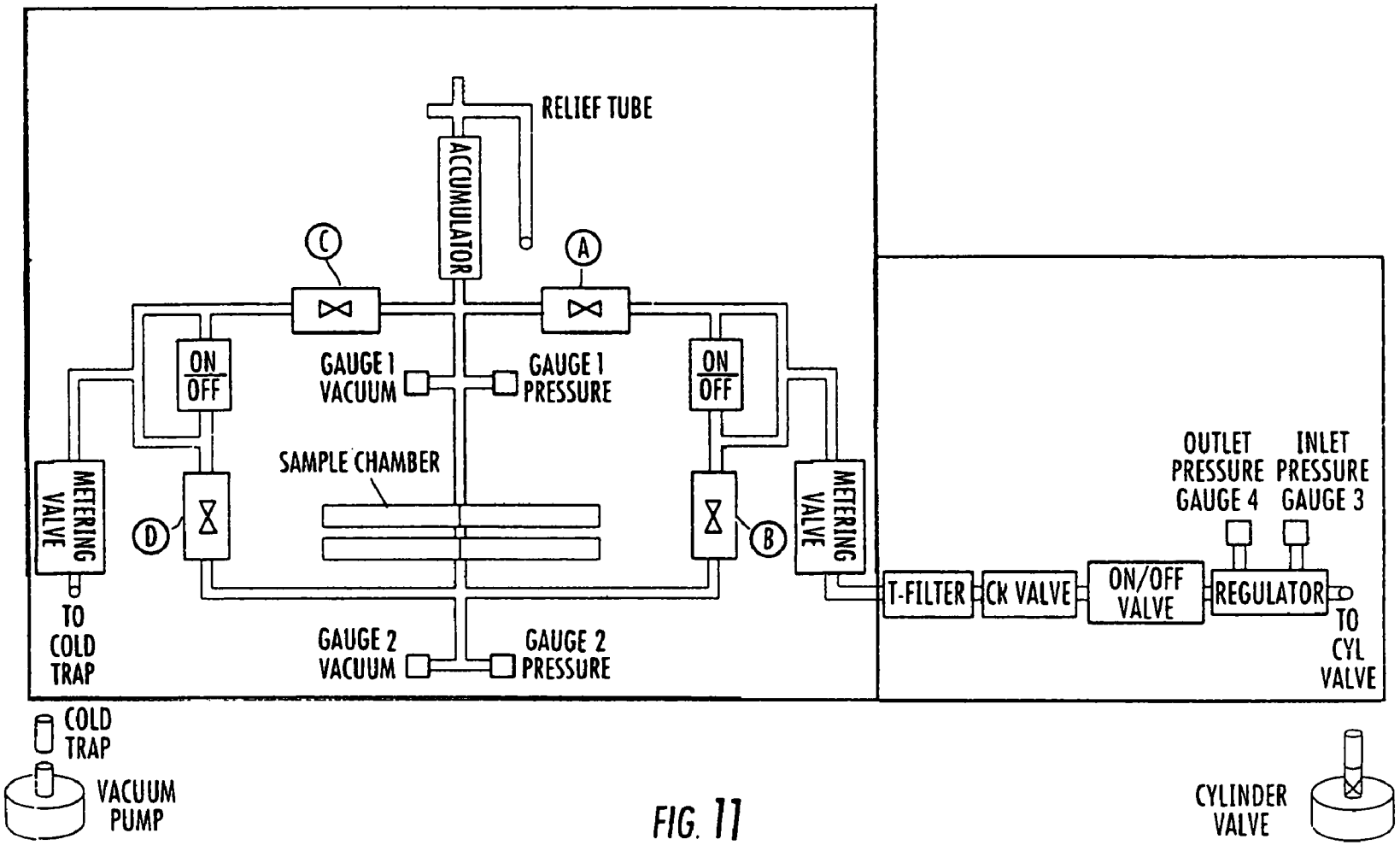
FIG. 11 is a more detailed diagrammatic representation of an embodiment of a forensic super-critical fluid extraction and detection system; and, FIG. 12 is a more detailed diagrammatic representation of various vacuum and pressure configurations possible for use in extraction in an exemplary forensic super-critical fluid extraction and detection system.

Referring to FIG. 11 there is shown a more detailed diagrammatic representation of the super critical fluid extraction and detection system. This representation depicts separate metering/control and sample pressure chamber assemblies, both surrounded by a shield enclosure. The right hand module (metering/control) is shown with connections to the super critical gas cylinder source/liquid $CO_2$ charge source, the on-off control valve, check valve, filling and metering valve are shown separated from the pressure chamber assembly.

The left hand module (pressure chamber assembly) is shown with the release/relief valve (in the standard MP-PITS configuration with accumulator). The optimal relief tube for connection to a) cold trap, b) injection port and/or c) mass spectrometer is shown connected to the sample chamber inlet manifold. Additionally shown is a digital transducer for monitoring/controlling the super critical pressure.

Figure 12:
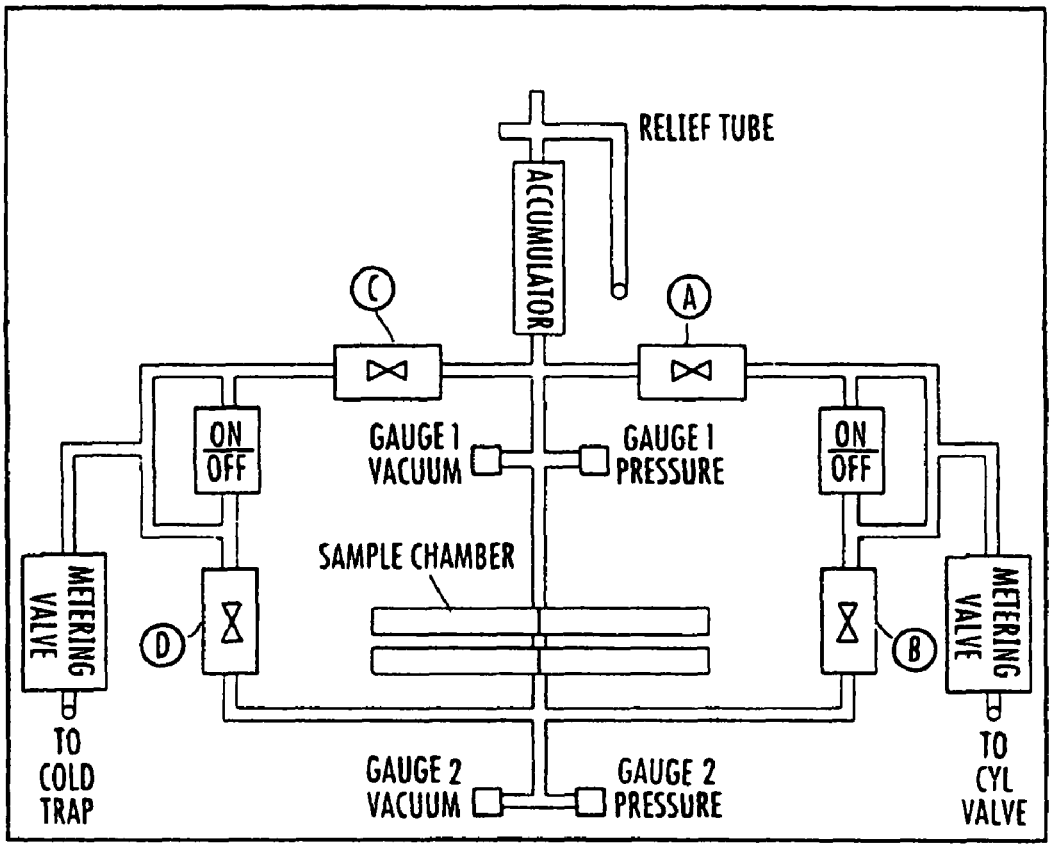

Referring to FIG. 12 there is shown a more detailed diagrammatic representation of the super critical fluid extraction and detection system. Shown in this representation is a schematic of the vacuum and pressure configuration options which may be selected to optimize the extraction process and may be varied dependent on sample size, type and chemical composition.

This diagram shows the options of:

a) pressure on top, vacuum on bottom;

b) pressure on top, pressure on bottom;

c) vacuum on top, pressure on bottom; and d) vacuum on top, vacuum on bottom.

The device for sampling and analyzing a target substance carried on a media used to collect the target substance includes a test chamber for receiving a sample, the test chamber including an output port, a pressurizer for creating a supercritical environment in the test chamber for a predetermined gas mix, and a profile controller for varying at least one of pressure, temperature or mechanical agitation of the test chamber. The device may further include a detector such as a mass spectrometer for receiving concentrated sample from the output port. In such a non-continuous system, a supercritical matrix may also be established in a manner previously described and very small quantities of energetic and toxic substances extracted from either a swab or from fragments of material submitted for analysis.

The extraction and detection system may also be utilized in a modular detection, decontamination and filtration system U.S. Provisional Patent Application No. 60/809,742, entitled Decontamination And Filtration System, filed on May 31, 2006, and herein incorporated by reference, discloses a such a system comprising a filter module; a rotational drive module; and, a monitor/detection module arranged sequentially. Each and/or any module of this extraction and detection system may have surfaces treated as described above to minimize depletion and/or catalytic modification of particulate material. The filter module comprises modular filter housing sections, application specific filter sets, test/sample sections and (as applicable) bubble tight dampers upstream and downstream of filter sets sequentially arranged. Bag in/Bag out may be standard for ail filter sets. Filters may include prefilter/s, HEPA, HEGA, HEGA/Scrubber, and others. An air flow sample is provided to the filter module and a filtered air flow sample exits the filter module. Sample sections consist of a flanged housing section with sample ports for sensing and/or extraction and may be provided at any position in the filter module flow path. Each filter stage in the module may also contain a pressure gauge port. Specialized "Scrubber" modules for gases (carbon monoxide) and for neutralizing and/or deactivating chemical agents may also be used. The rotational drive module comprises an explosion proof motor, programmable motor controller/phase converter, gastight fan housing with explosion resistant fan and real-time software/hardware for air flow management. Air flow from the rotational drive module is provided to a monitor/detection module which gathers, extracts and detects substances of interest in the air flow (i.e., particulate material) provided.

The monitor/detection module is capable of determining filter remaining life/capacity; logging total filter system throughput in cubic feet, type and quantities of gas/es that have passed into the filter/s; regulating the volume of airflow through the filter train to minimize filter stress and increase filter life—in addition to reducing the energy loading of the RDM; determining in real time the need for filter substitution should a substance not compatible with the existing filter train become detected; and tracking filter life/capacity by filter serial number to enable removal/reuse of individual filters, subject to limitations related to toxic materials contamination.

The filter module of the modular detection, decontamination and filtration system includes individual filter packs each with a memory device, filter pack housings with sample/measurement gas ports, and gauges for measure airflow. The filter module is connected to the monitor and detection module via a gas port connection to the detector module selector valve. A controller measures and controls the gas flow from the individual gas ports to the detector of the monitor and detection module. A cylinder provides a purge/signal gas for injection in the line between the gas ports and the detector. The rotational drive module include an inverter/motor drive interfaced to a controller; an explosion-proof motor and a spark resistant blower/fan.

The system operates by alternately sampling gas composition from front to back (in direction of airstream through filter train) between the sample port upstream of the pre-filter module to the sample port downstream of the final filter pack stage. Sample rates may be set proportional to airflow velocity and CFM value. As each sample period ends the selector valve is rotated to the next sample in the stream sequence. Immediately prior to the sample valve inlet opening a slug of purge gas is introduced in the line. Receipt of the purge/signal gas (selected to be unique in the airstream—not to be normally encountered during projected filter operation) in the detector, such as a mass spectrometer or gas chromatograph, resets the counter/integration values for the filter position being sampled. This process is iterative. Sample values are logged and stored on archival media in the monitor/detector module. Individual filter pack memory modules are updated in synchronization with the sample process. Integration of quantity and time/airflow values determines amount of substance per each mass category (gas or contaminant type). The integration is conducted utilizing spectral peak intensity to quantity (concentration) algorithms for the various gases to be filtered.

The quantity (concentration) value is then multiplied by the length of time the spectral peak intensity value remains at discrete value sets. The time integrated quantity of measured substance is then converted to a mass value which in turn is then used to determine filter loading. Filter life remaining is calculated based on the total filter module media mass and the known maximum mass loading for the specific media. This value is determined by (usually at/by the media manufacturer) saturating a known mass value of the filter media with the substance to be filtered and measuring the mass increase. At the option of the operator this value may be set at any selected percentage of the maximum filter loading—for example 25% of the filter loading. When this value is reached for the specific filter module the operator is alerted and the filter may be changed. A table comprising the maximum mass loading for a variety of substances to be filtered is stored in the filter module memory device and interrogated by the computer as required.

For highly toxic compounds, residence time calculations are made to determine possible breakthrough limits. The residence time calculation is made by dividing the bed volume in cubic feet by the rate of airflow in CFM and multiplying the result by 60 seconds. For carbon based filter media, the carbon density is 30 lbs per cubic foot. For example, for a 125 lb media bed filter, the bed volume would be 125/30=4.17 cubic feet. For an airflow of 1660 CFM, the residence time would be (4.17/1660)×60 seconds=0.1506 seconds—approximately ⅛ second. In the industry, 0.25 second is usually the standard minimum residence time to provide the maximum safety margin. Placing two of the filter modules with residence times of 0.1506 seconds in series produces an aggregate residence time of 0.3012 second—well over the recommended minimum of 0.25 second.

Airflow quantities are determined by measuring the static pressure drop (vacuum) created by flow through a fixed area—the width and height of the filter module internal geometry. This is accomplished with a measuring device, such as a digital vacuum gauge, manometer, or pitot tube via the sample and gauge port/s on each individual filter module housing. Airflow sensing is utilized to regulate the volume and velocity of airflow though the filter system under program control. This is accomplished by measuring the static pressure drop at numerous points along the airflow path with measuring devices and adjusting the airflow as required by varying the fan/blower speed via the motor drive inverter.

The process of modular detection, decontamination and filtration system involves determine a configuration of the filter module; determine a characteristic of a filter pack in the filter module, determine airflows and minimum residence times for an intended operation, maintain a designated airflow through the system, updating the characteristic of the filter pack to reflect operation of the system, determining when the characteristic of the filter pack has meet a predetermined limit. A warning signal can be generated when the predetermined limit is met.

The designated airflow is maintained by first fixing a blower at a first predetermined setting, thereafter sensing variations in a designated airflow and adjusting the blower to a second predetermined setting. After determination the filter module configuration and determination of the characteristic of the filter packs in the filter module, such information including remaining life expectancy of individual filter packs can be presented to the system operator for confirmation to proceed prior to initiation of airflow. The system may also request operator verification that all filter packs are relevant for the intended application. For example, the system may request the operator to select a gas that the system may be expected to filter or treat. Based on that selection, the system can inform the operator if the existing filter packs will suffice for the intended application.

The invention is described with reference to methods, apparatuses and computer programs and program products according to illustrative embodiments. This invention may, however, be embodied in many different forms and should not be construed as limited to the embodiments set forth herein; rather, the illustrative embodiments provide a thorough and complete disclosure, fully conveying the scope of the invention to those skilled in the art. It will be understood that steps of the method, and accommodations for each step of the method, respectively, can be implemented by computer program instructions. These computer program instructions may be loaded onto one or more general purpose computers, special purpose computers, or programmable data processing apparatus to produce machines, such that the instructions which execute on the computers or other programmable data processing apparatus create means and apparatuses for implementing the functions specified. Such computer program instructions may also be stored and/or loaded in a computer-readable memory that can direct a computer or other programmable data processing apparatus to function in a particular manner or cause a series of operational steps to be performed, such that the instructions stored in the computer-readable memory produce an article of manufacture including instruction means that implement the functions specified and described herein.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claims, is reserved.

What is claimed is:

1. A supercritical fluid extraction sampling and analysis device comprising:

a vacuum;

a mixing module, the vacuum transporting particulate material in air suspension to the mixing module, the mixing module operative to create a supercritical matrix containing the particulate matter;

a separator operative to separate waste in the supercritical matrix, the separator including a trap for removing the separated waste from the supercritical matrix;

a heated tube arm, the heated tube arm receiving the supercritical matrix from the separator and reducing solvent in the supercritical matrix;

a collector concentrating particulate material in the heated tube; and a laser, the laser continuously volatilizing particulate material at the collector.

2. The extraction and analysis device according to claim 1 further comprising:

an agitator, the agitator operative to generate the particulate material from a surface.

3. The extraction and analysis device according to claim 1 further comprising:

a mass spectrometer, the mass spectrometer receiving volatilized particulate material for analysis and detection of a target material.

4. An extraction sampling and analysis device comprising:

a vacuum;

a mixing module, the vacuum transporting particulate material in air suspension to the mixing module, the mixing module mixing an air suspension of the particulate matter with a supercritical fluid to create a supercritical matrix containing the particulate matter;

a separator operative to separate waste in the supercritical matrix, the separator including a trap for removing the separated waste from the supercritical matrix; and a spray module, the spray module vaporizing the supercritical matrix.

5. The extraction and analysis device according to claim 4 further comprising:

an agitator, the agitator operative to generate the particulate material from a surface.

6. The extraction and analysis device according to claim 4 further comprising:

a mass spectrometer, the mass spectrometer injected with the supercritical matrix from the spray module for analysis and detection of a target material.

7. A system for the extraction and analysis of a substance, the system comprising:

a vacuum for collecting particulate matter for testing, the particulate matter including waste material;

a mixing module for mixing an air suspension of the particulate matter with a supercritical fluid for creating a supercritical matrix including the particulate matter;

a separator for removing at least a portion of the waste material in the supercritical matrix thereby leaving residual particulate matter in the supercritical matrix;

an injection device providing concentrate of the residual particulate matter in the supercritical matrix for analysis, the injection device comprises:

a heated tube, a first end of the heated tube receiving the supercritical matrix from the separator;

a collector plate positioned proximate a second end of the heated tube, concentrate of the residual particulate matter being deposited on the collector plate;

and a laser for volatilizing the concentrate deposited on collector plate; and a mass spectrometer, the mass spectrometer operative to develop a characterization of the concentrate received from the injection device.

8. The system for the extraction and analysis of a substance according to claim 7 further comprising an agitator generating the particulate matter.

9. The system for the extraction and analysis of a substance according to claim 7, wherein the agitator comprises a rake or a means for generating a directed stream of air.

10. The system for the extraction and analysis of a substance according to claim 7, wherein the mixing module comprises:

a chamber in which the particulate matter is combined with a supercritical fluid.

11. The system for the extraction and analysis of a substance according to claim 7, wherein the separator comprises:

a chamber having an input port, an output port and an exhaust valve; and an agitation device, the agitation device capable of being rotatably driven through the chamber.

12. The system for the extraction and analysis of a substance according to claim 11, wherein the agitation device is a double wedged agitation device, the double wedged agitation device comprising a first wedge, all walls of the first wedge intact; and a second wedge, the second wedge having an open exterior face and hollow interior, the first and second wedges sharing a common single wall.

13. The system for the extraction and analysis of a substance according to claim 7, the system further comprising:

a plurality of core processors, the core processors operative to analyzing the characterization of the concentrate and detect a presence of an energetic substance.

14. The system for the extraction and analysis of a substance according to claim 7, the system further comprising:

a plurality of core processors, the core processors operative to comparing the characterization of the concentrate to a characterization of an energetic substance; and identifying matching characterizations.

15. The system for the extraction and analysis of a substance according to claim 14, wherein the system operates in proximate real-time or in real-time.

16. The system for the extraction and analysis of a substance according to claim 7, wherein the injection device comprises:

a spray module for nebulizing the supercritical matrix containing the residual particulate matter.

* * * * *